US010038953B2

(12) United States Patent
Hui

(10) Patent No.: US 10,038,953 B2
(45) Date of Patent: Jul. 31, 2018

(54) SPEAKER

(71) Applicant: Yao Hui, Shenzhen (CN)

(72) Inventor: Yao Hui, Shenzhen (CN)

(73) Assignee: AAC TECHNOLOGIES PTE, LTD., Singapore (SG)

( * ) Notice: Subject to any disclaimer, the term of this patent is extended or adjusted under 35 U.S.C. 154(b) by 0 days.

(21) Appl. No.: 15/416,128

(22) Filed: Jan. 26, 2017

(65) Prior Publication Data

US 2018/0124503 A1 May 3, 2018

(30) Foreign Application Priority Data

Oct. 28, 2016 (CN) ..... 2016 2 1194579 U

(51) Int. Cl.

| | |
|---|---|
| ***H04R 1/20*** | (2006.01) |
| ***H04R 1/28*** | (2006.01) |
| ***H04R 9/02*** | (2006.01) |
| ***H04R 9/06*** | (2006.01) |
| ***H04R 1/02*** | (2006.01) |

(52) U.S. Cl.

CPC ..... *H04R 1/2811* (2013.01); *H04R 1/02* (2013.01); *H04R 9/025* (2013.01); *H04R 9/06* (2013.01)

(58) Field of Classification Search

CPC .. H04R 7/20; H04R 1/2876; H04R 2307/027; H04R 2307/204; H04R 25/505; H04R 9/025; H04R 9/06; H04R 9/10; H04R 19/016; H04R 1/06; H04R 1/1016; H04R 1/1058

USPC ..... 381/397, 412, 386, 162; 181/199

See application file for complete search history.

(56) References Cited

U.S. PATENT DOCUMENTS

| | | | | |
|---|---|---|---|---|
| 2007/0177756 | A1* | 8/2007 | Kemmerer | H04R 9/022 381/397 |
| 2016/0316287 | A1* | 10/2016 | Li | H04R 1/025 |
| 2016/0329041 | A1* | 11/2016 | Qi | H04R 1/2811 |
| 2016/0345090 | A1* | 11/2016 | Wilk | B01D 53/04 |
| 2017/0164084 | A1* | 6/2017 | Vitt | H04R 1/086 |

* cited by examiner

*Primary Examiner* — Matthew Eason
*Assistant Examiner* — Julie X Dang
(74) *Attorney, Agent, or Firm* — Na Xu; IPro, PLLC

(57) ABSTRACT

A speaker is disclosed. The speaker includes a housing with an accommodation space; a speaker unit accommodated in the housing; a back cavity formed between the speaker unit and the housing; and at least a first leak formed on the housing communicating with the back cavity. One end of the leak is connected to the back cavity, and the other end is connected to the outside of the speaker.

12 Claims, 3 Drawing Sheets

SPEAKER

FIELD OF THE PRESENT DISCLOSURE

The present disclosure relates to the field of electro-acoustic transducers, and more particularly to speaker.

DESCRIPTION OF RELATED ART

With the arrival of the mobile internet era, the amount of the smart mobile equipment has been increasing. However, among many mobile types of equipment, the mobile phone is a kind of mobile terminal equipment which is most common and portable undoubtedly. At present, there are diverse functions of the mobile phone, and one of the important functions is the high quality music function, and the speaker in the mobile phone is one of the necessary conditions to achieve this high quality music function.

The key purposes of both the magnetic circuit leak of the speaker unit in the relevant technology and the BOX pressure balance hole of the speaker cavity are to balance the air pressure. The pressure balance and damping adjustment of the leak or pressure balance hole are achieved by the solutions of damping cloth, lengthening the piping and cooperation between the dustproof net and foam. The adjustment method is mainly based on the train of thought of laminar control; the effect of the turbulence during flowing is not applied. When the leak in the speaker is less than one specific size, e.g. 0.1 mm, the air movement driven by the vibration of the speaker's dome will generate bigger flowing velocity at the leak or pressure balance hole, in order to generate significant turbulence when the amplitude is big; the turbulence doesn't meet Newton law of viscosity, and its momentum transfer is a result which is caused by the common action by the molecular diffusion and vortex diffusion, and the formula is as follows:

$$\tau = (\eta + \eta_e)\frac{du}{dy}$$

where, ηe is a coefficient of the turbulence viscosity which is not related to the fluid itself. The viscosity characteristics of the air can become the damping of the vibration of the speaker under a special design, and the mechanical quality factor of the speaker can be adjusted effectively by proper design of the structure and flow field, thereby optimizing the vibration performance of the speaker.

Thereof, it is necessary to disclose and provide an improved speaker to overcome the above-mentioned disadvantages.

BRIEF DESCRIPTION OF THE DRAWING

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
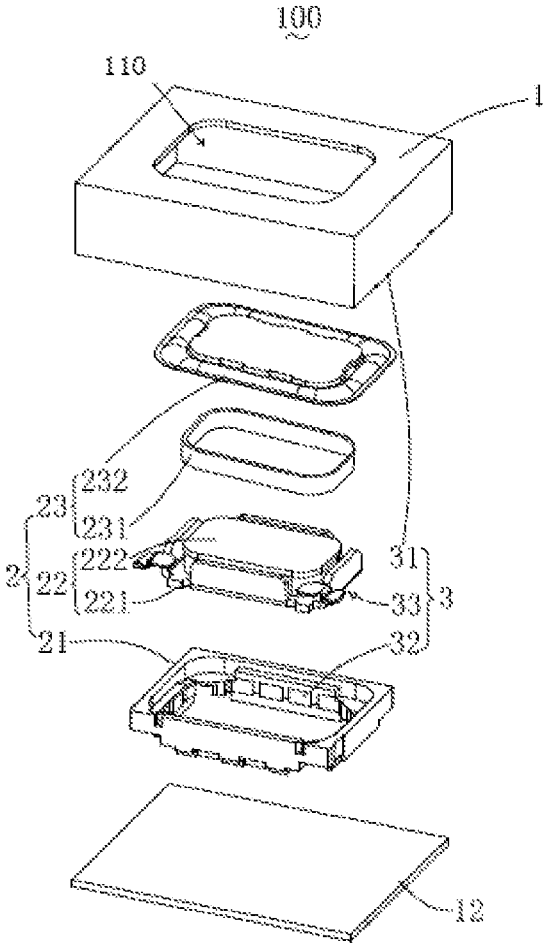
FIG. 1 is an isometric and exploded view of a speaker in accordance with an exemplary embodiment of the present disclosure.
Figure 2:
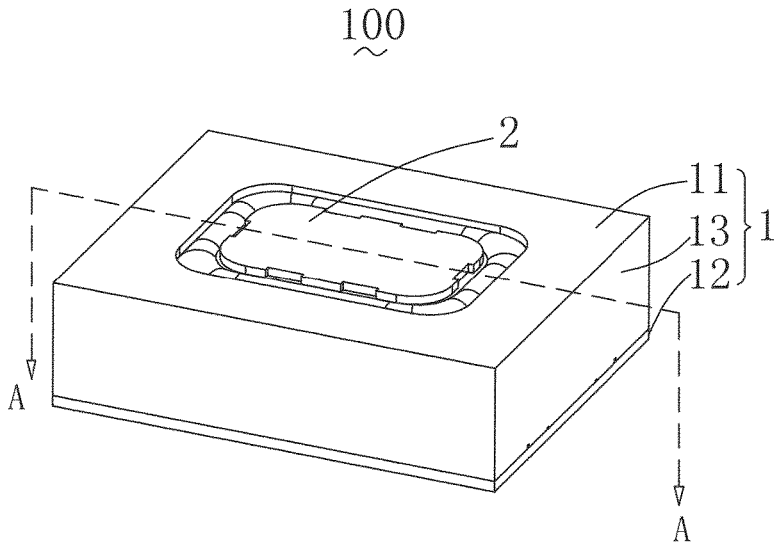
FIG. 2 is an isometric and assembled view of the speaker in FIG. 1.
Figure 3:
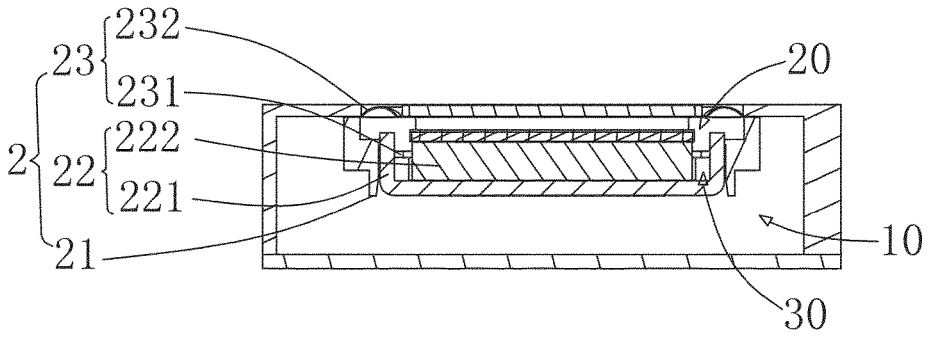
FIG. 3 is a cross-sectional view of the speaker taken along line A-A in FIG. 2.
Figure 4:
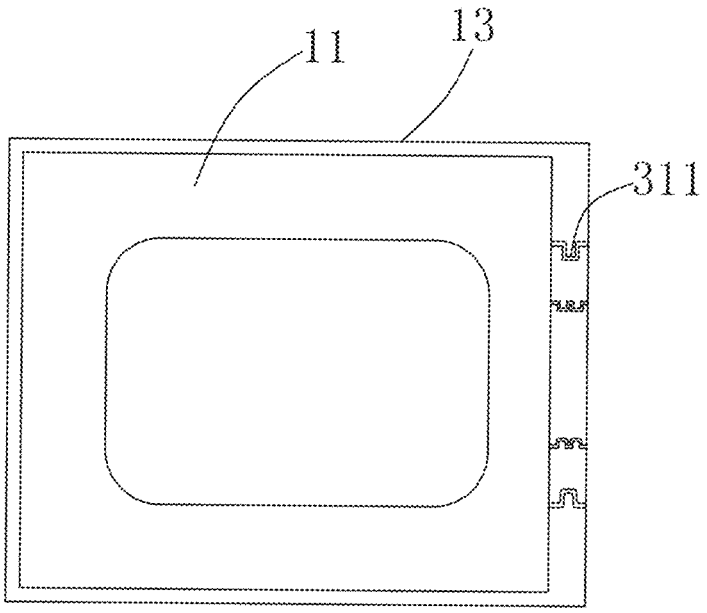
FIG. 4 is a schematic diagram of a parting surface of a back cavity of the speaker.
Figure 5:
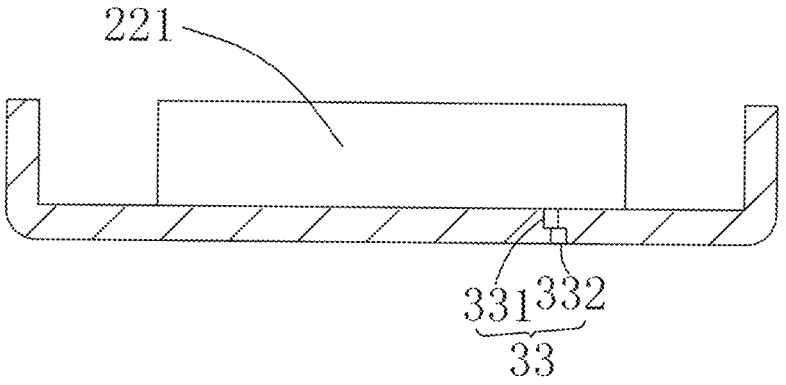
FIG. 5 is a cross-sectional view of a magnetic yoke of the speaker.

Referring to FIGS. 1-5, a speaker 100 comprises a housing 1 with an accommodation space, and a speaker unit 2 which is accommodated in the housing 1. A back cavity 10 is formed between the speaker unit 2 and the housing 1, and a plurality of leaks 3 formed on the housing 1 which are communicated with the back cavity 10.

The speaker unit 2 comprises a frame 21, a magnetic circuit system 22 and a vibration system 23 which are accommodated in the frame 21. An inner cavity 20 is formed between the vibration system 23 and the magnetic circuit system, and the magnetic circuit system 22 and the frame 21 are stuck.

The housing 1 comprises an upper wall 11, a base plate 12 opposite to the upper wall 11 and keeping a distance from the speaker unit 2, and a side wall 13 extending from an edge of the upper wall 11 to the base plate 12. A sound outlet 110 is formed on the upper wall 11, corresponding to the vibration system 23.

The leak 3 comprises a first leak 31 opened in the side wall 13, a second leak 32 which connects the air pressure between the inner cavity 20 and the back cavity 10, and a third leak 33 connecting the air pressure between the inner cavity 20 and the back cavity 10.

The first leak 31 communicates the back cavity 10 with the outside; the first leak 31 bends from the side wall 13 and extends to the outer surface of the side wall 13.

The second leak 32 is formed inside where the frame 21 contacts the magnetic circuit system 22; and the second leak 32 has a concave groove with a bending trajectory, specifically, there are multiple second leaks 32 which are distributed in array.

The magnetic circuit system 22 comprises a magnetic yoke 221 which is stuck with the inside of the frame 21, and a magnet 222 which is accommodated at one side of the magnetic yoke 221 towards the vibration system 23. A gap 30 between the edge of the magnetic yoke 221 and the magnet 222 is connected to the inner cavity 20. The vibration system 23 comprises a voice coil 231 and a diaphragm 232 covered by one side of the frame 21 away from the base plate 12. The third leak 33 corresponds to the gap 30 and penetrates the magnetic yoke 221.

The third leak 33 comprises an upper part 331 and a lower part 332 displacing relative to the upper part 331. One end of the upper part 331 penetrates the inner surface of the magnetic yoke 221 which is opposite to the vibration system 23 and is connected to the inner cavity 20, and the other end is connected to the lower part 332. One end of the lower part 332 away from the upper part 331 is communicated with the back cavity 10.

The shapes of the cross sections of the upper part 331 and the lower part 332 can be round, half-round, square, oval, trapezoid, triangle or a combination of any shapes.

The first leak 31 is set on the parting surface of a back cavity of the housing 1. There are multiple first leaks 31, and the multiple first leaks 31 are distributed symmetrically, and every first leak 31 comprises several ventholes with bending trajectories, in this embodiment, the first leak 31 is connected and formed by several concave holes 311, and the concave holes 311 are the ventholes with concave trajectories. The inner bending area of the trajectory can be a bend by round angle or right angle.

The first leak 31 is used for adjusting the air pressure between a back cavity 10 of a speaker and the outside, as for the back cavity of the speaker 10, due to part area of it cooperates with the inside of the equipment including mobile phone etc, the effect to the volume of the cavity by increasing the thickness of the material in this area is smaller; two concave holes 311 can be designed by structure symmetrically, or multiple concave holes 311 can be designed randomly by performance demand, and the sizes of the multiple concave holes 311 can be adjusted by the demand of the audio characteristic frequency, in order to increase or decrease the vibration damping under one frequency.

The air turbulence required by damping design is generated at the bending trajectory of the concave hole 311, and the damping generated by this turbulence can present different damping by frequency; as for the bending hole group with two concave holes 311, the turbulence damping under this frequency can be increased accordingly, in order to control the vibration damping.

There are several third leaks, and different number of leaks 33 can be set by the model of the speaker 1, which is not limited to the one disclosed in this embodiment.

Both the second leak 32 and the third leak 33 are used for adjusting the air pressure between the speaker's monomer 2 and a back cavity 10 of the speaker, and the damping parameter required by the speaker 1 can be obtained by calculation quickly and accurately, in order to adjust the vibration damping of different models of the speakers 1 under different frequencies by combining the analysis of the flow field and the process design.

In other alternative embodiment, the number and structure of the first leak 31, the second leak 32 and the third leak 33 can be set as required, without limiting to the technological scheme which is disclosed in this embodiment, e.g. only one of the second leak 32 and the third leak 33 is further set on the basis of the first leak 31.

Comparing with relevant technologies, a speaker 1 includes leaks 3 with different structures on a housing 1 and a speaker unit 2, which can adjust the vibration damping of different models of speakers 1 at different frequencies, in order to optimize the vibration performance of the whole module, and control the mechanical quality factor and reduce the acoustic distortion effectively; besides controlling the damping, the volume rigidity Cab at the back cavity of the speaker can be reduced effectively by distributing the mass flow and air volume in many holes, in order to reduce the effect to the monomer performance by the cavity, and reduce the resonance frequency F0 of the whole module.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker comprising:

a housing with an accommodation space;

a speaker unit accommodated in the housing, the speaker unit comprising a frame, a magnetic circuit system, and a vibration system which are accommodated in the frame;

a back cavity formed between the speaker unit and the housing away and isolated from the vibration system;

at least a first leak formed on the housing communicating with the back cavity, one end of the leak connected to the back cavity, and the other end connected to the outside of the speaker, the first leak separated from the vibration system by the frame and the magnetic circuit system, the first leak including a bending trajectory.

2. The speaker as described in claim 1, wherein the housing comprises an upper wall, a base plate opposite to the upper wall and keeping a distance from the speaker unit, and a side wall extending from an edge of the upper wall to the base plate; the first leak is opened on the side wall.

3. The speaker as described in claim 2, wherein the upper wall and the side wall are integrated, and the first leak is formed on an interface between the side wall and the base plate.

4. The speaker as described in claim 3, wherein the first leak bends from the inner surface of the side wall and extends to the outer surface of the side wall.

5. The speaker as described in claim 1, wherein an inner cavity is formed between the vibration system and the magnetic circuit system.

6. The speaker as described in claim 5 further comprising a second leak, and at least part of the second leak is formed at an inside where the frame contacts the magnetic circuit system.

7. The speaker as described in claim 6, wherein the second leak is a concave groove with a bending trajectory.

8. The speaker as described in claim 7, wherein the magnetic circuit system comprises a magnetic yoke, a magnet carried by the magnetic yoke, a gap formed between the magnetic yoke and the magnet and communicating with the inner cavity.

9. The speaker as described in claim 8 further comprising a third leak corresponding to the gap and penetrating through the magnetic yoke, and the third leak communicates the inner cavity with the back cavity.

10. The speaker as described in claim 9, wherein the third leak comprises an upper part and a lower part displacing relative to the upper part, one end of the upper part penetrates through the inner surface of the magnetic yoke for communicating with the inner cavity, and the other end is connected to the lower part, one end of the lower part communicates with the back cavity.

11. The speaker as described in claim 1, wherein a sound outlet is formed on the housing corresponding to the vibration system and separated from the back cavity.

12. The speaker as described in claim 11, wherein the frame is fixed to the housing and deposited around a periphery of the sound outlet.

* * * * *